United States Patent [19]

Jennings

[11] Patent Number: 4,825,571

[45] Date of Patent: May 2, 1989

[54] RETRACTABLE CALENDAR

[76] Inventor: Oliver Jennings, 10205 Dr. Martin Luther King Dr., Chicago, Ill. 66028

[21] Appl. No.: 53,832

[22] Filed: May 26, 1987

[51] Int. Cl.[4] ..... G09D 3/10

[52] U.S. Cl. ..... 40/116; 40/470; 40/514

[58] Field of Search ..... 40/116, 117, 514, 515, 40/904, 348, 601, 470, 516; 160/310

[56] References Cited

U.S. PATENT DOCUMENTS

| | | | |
|---|---|---|---|
| 125,966 | 4/1872 | Lovell | 40/514 |
| 316,771 | 4/1885 | Gerdom | 40/514 |
| 2,486,463 | 11/1949 | Chausse | 40/515 |
| 2,506,209 | 5/1950 | Glass | 40/514 |
| 3,510,973 | 5/1970 | Mazzocco, Sr. | 40/471 |
| 4,060,310 | 11/1977 | Brown | 160/310 |
| 4,345,392 | 8/1982 | Cornell | 40/116 |
| 4,525,946 | 7/1985 | Olson | 40/514 |

FOREIGN PATENT DOCUMENTS

| | | | |
|---|---|---|---|
| 484800 | 11/1951 | Canada | 40/514 |
| 2423019 | 12/1970 | France | 40/601 |
| 701925 | 3/1966 | Italy | 40/117 |
| 301973 | 12/1928 | United Kingdom | 40/514 |

*Primary Examiner*—Robert P. Swiatek
*Assistant Examiner*—Cary E. Stone
*Attorney, Agent, or Firm*—Frank J. Uxa

[57] ABSTRACT

An apparatus for use as a calendar comprising: a flexible member on which is located a calendar element including calendar information on a plurality of dates; a spool associated with the flexible member and around which the flexible member is capable of being wound; and an activator associated with the spool and capable of being activated to wind and unwind the flexible member around the spool.

19 Claims, 1 Drawing Sheet

RETRACTABLE CALENDAR

BACKGROUND OF THE INVENTION

This invention relates to a calendar system. More particularly, the invention relates to a calendar system which can be conveniently displayed and then retracted, e.g., out of sight, if desired, when the calendar information is not being referred to.

There are a great many calendars of various sizes, designs and configurations that have been proposed or are in use at the present time. For example, in preparing this application, the following U.S. Patents, each of which relate to calendars, were considered: U.S. Pat. Nos. 2,014,863; 2,073,275; 2,356,107; 2,470,693; and 4,308,678.

Calendars are clearly essential in order to keep track of time and one's schedule of appointments and engagements into the future. For example, calendars are often written upon in order to designate a specific event that is to happen or a specific date in the future. While such calendars should be available on a continuous basis for reference, they are not continuously referred to. When they are not being referred to, they often occupy useful wall or desk space which might be used in other ways. Also, if the marked-up calendar is always in sight, it may provide information to your visitors which you would prefer be kept confidential.

SUMMARY OF THE INVENTION

A new apparatus for use as a calendar has been discovered. In one broad aspect, this apparatus comprises: flexible means on which is located calendar indicia means including calendar information on a plurality of dates; spool means associated with the flexible means and around which the flexible means is capable of being wound; and means, preferably an electrically powered motor, associated with the spool means and capable of being activated to wind and unwind the flexible means around the spool means, as desired. Preferably, the flexible means is structured so that when the flexible means is would around the spool means, the calendar indicia means is out of sight.

The present "retractable" calendar provides substantial advantages. For example, the present system allows for quick and easy reference to the calendar information, i.e., date number, date month, and/or day of the week, for the days on the calendar indicia means. The system also allows this calendar information, and any other information that might have been placed on the flexible means and/or the calendar indicia means to be wound up on the spool means, preferably out of sight, as desired. This feature gives one the opportunity to increase the usefulness of valuable wall or desk space while still being able to refer to a multi-day calendar, when desired. Since the calendar and other information on the flexible means is preferably retractable out of sight, one can keep such information, e.g., your schedule of appointments, out-of-town traveling plans and the like, confidential as desired. In short, the present calendar system simply, yet effectively fills a need, e.g., for a useful multi-day calendar, more effective space utilization and/or increased confidentiality.

As noted above, it is preferred that the flexible member be structured so that when it is wound around the spool the calendar indicia means is out of sight. In addition, it is preferred that at least one, preferably both, of the flexible means and the calendar indicia means be structured to be capable of being written upon. In other words, one or both of these components be of suitable construction so that one can write in scheduling and/or other information, as desired. In one embodiment, the flexible means is constructed of paper, plastic or like material, e.g., in a sheet, and the calendar indicia means is printed, stamped or otherwise placed, preferably on one side, of the paper or like material. In another embodiment, the calendar indicia means is removably secured, preferably adhesively secured, to the flexible means. For example, the calendar indicia means may comprise a sheet of paper, plastic or the like with the calendar information on one side and an adhesive, e.g., a peel-off adhesive, on the other side. The adhesive-containing side is stuck to the flexible means so that the calendar information faces out from the flexible means. After the calendar information on this calendar indicia means becomes obsolete, it is simply removed from the flexible means and replaced by a new calendar indicia means backed with adhesive. Such calendar indicia means may be transparent (other than the calendar information thereon), or it may include an ornamental design.

The present calendar indicia means includes calendar information on a plurality of dates, i.e., relating to a plurality of days. The calendar indicia means preferably includes calendar information on at least one week, more preferably on at least one month and still more preferably on at least one year. The calendar indicia means may include some type of perpetual calendar information, i.e., information which relates to every date or day.

In one embodiment, at least one, preferably both, of the flexible means and the calendar indicia means are erasable. That is, if, as is preferred, the flexible means and/or the calendar indicia means can be written upon, it is further preferred such writing be removable. This is particularly important if the flexible means and/or calendar indicia means are to be used over an extended period of time.

In one embodiment, the flexible means is preferably normally attached to the spool means. This feature allows the flexible means to be replaced, as needed, e.g., when the calendar information thereon is obsolete and the calendar indicia means is permanently placed thereon. In a particularly useful embodiment, the spool means includes a slit-like structure and the flexible means includes a first end which is structured to fit into the slit to removably attach the flexible means to the spool means. The flexible means can be detached from the spool means simply by removing the first end of the flexible means from the slit.

This slit in the spool means preferably runs at least a substantial portion of the length of the spool means. In one embodiment, this slit preferably has a T-shaped cross-section. This is particularly effective in removably attaching the flexible means to the spool means.

The spool means is preferably removably secured to the activator means. In one specific embodiment, the spool means preferably includes a first end and a substantially opposing second end. First and second mounting means are provided and act to support the spool means at or near the first end and second end, respectively, of the spool means. More preferably, at least one of these first and second mounting means includes a notch structured to receive the spool means at or near the first or second ends of the spool means.

The present activator means may involve a handle and the like associated with the spool means and capable of being manually operated to wind and unwind the flexible means around the spool means. However, in one embodiment, it is preferred that the activator means be electrically powered. In a particularly useful embodiment, the activator means comprises a bi-directional, electrically powered motor, e.g., of conventional design. Such bi-directional motor is run in one direction to turn the spool means to wind the flexible means, and run in the opposite direction to turn the spool means to unwind the flexible means. The actual activation of this motor is preferably controlled by push button switch means, e.g., which are manually operated. Preferably, the spool means is secured, more preferably removably secured to the spool means.

The present calendar means preferably further comprises cover means acting to substantially completely cover the spool means. The cover means is, however, structured to allow the flexible means to extend out of the cover means when the flexible means is unwound from the spool means. The flexible means may extend in any direction, e.g., upwardly, downwardly, forwardly, backwardly, to the left side or to the right side, from the spool means. The cover means may have a polished or otherwise pleasing-to-the-eye finish to give the present system a pleasant appearance when the flexible means is wound around the spool means.

The present system may be hung, adhesively secured to or otherwise secured to the wall or other component in one's office, home or other place where it is desired to use the system. In one embodiment, the calendar of the present invention is placed on, e.g., secured to, a desk or other piece of furniture.

These and other aspects and advantages of the present invention are set forth in the following detailed description and claims, particularly when considered in conjunction with the accompanying drawings in which like parts bear like reference numerals. In the drawings:

Figure 1:
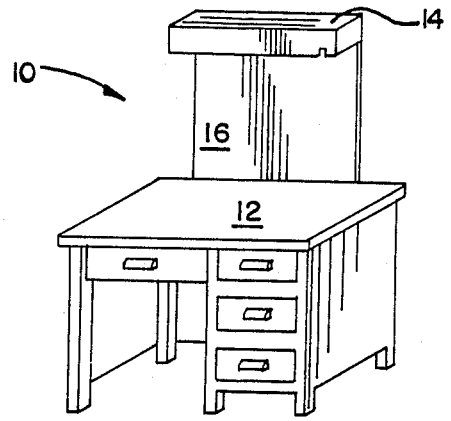
FIG. 1 is a top side view, in perspective, showing an embodiment of the present invention in use on a desk top.
Figure 2:
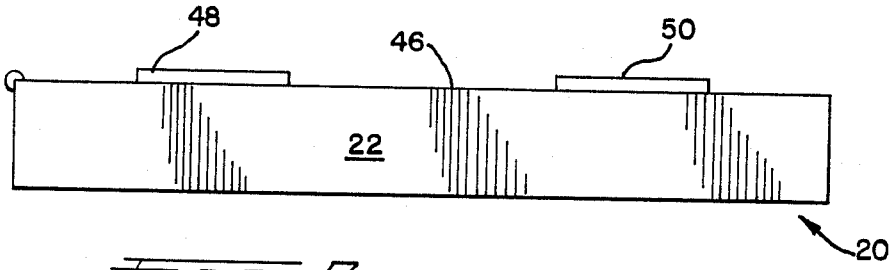
FIG. 2 is a top plan view of another embodiment of the present invention.

Referring now to the drawings, FIG. 1 shows a desk-mounted calendar unit, shown generally at 10, mounted onto the back of a desk 12. Unit 10, as shown in FIG. 1, includes a cover 14 and a back plate 16 is an integral part of cover 14 and extends downwardly to be secured, e.g., bolted, to desk 12. When the calendar information is retracted, i.e., wound on a spool inside cover 14 as will be discussed hereinafter, back plate 16 is visible. Therefore, back plate 16 may include some ornamental design, may include photographs or may otherwise be used effectively to aid in making desk 16 more pleasant to the person who works there. Also, back plate 16 can be effectively used as a support to facilitate writing notes on the calendar when it is descended from cover 14.

FIG. 2, 3, 4 and 5 relate to a wall-mounted calendar unit, shown generally at 20. Unless indicated differently, the components of desk unit 10 and wall unit 20 are substantially similar and function in a substantially similar manner. In describing these components and their functioning, wall unit 20 is emphasized, it being understood that such description applies substantially equally to desk unit 10.

Wall unit 20 includes a cover 22, a spool 24, a first mounting bracket 26, a second mounting bracket 28, a connector 30, an electrically powered, bi-directional motor 32, a first rigid lead 34, a second rigid lead 36, a first electrical storage battery 38, a second electrical storage battery 40, a first spring biased push-button switch 42 and a second spring biased push-button switch 44. The back surface 46 of cover 22 includes a first adhesive pad 48 and a second adhesive pad 50, each of which can be used to adhesively secure wall unit 20 to a wall, e.g., in an office or other room or location. A flexible sheet of paper 56 is removably secured to spool 24, and can be wound around or unwound from spool 24, as desired, by turning spool 24. Adhesively secured to paper sheet 56 is another flexible sheet 58 which includes calendar information for an entire year. It is understood that paper sheet 56 and flexible sheet 58 can be made into one integral component or can be two separate components with flexible sheet 58 being removably secured to paper sheet 56. Both of these modifications are included in the scope of the present invention. Flexible sheet 58 can be written upon and such writing can be erased, as desired.

The bottom 60 of cover 22 includes a hole 61 through which paper sheet 56 and flexible sheet 58 can emerge from cover 22.

First bracket 26 is secured, e.g., adhesively secured, to the interior of back surface 46, and extends outwardly into the interior of cover 22. First bracket 26 includes a notch 62 which acts as a support or cradle a cap extension 64 so that cap extension 64 can rotate within notch 62. Cap extension 64 is part of a threaded cap 66 which matingly engages the threads located near the first end 68 of spool 24. Threaded cap 66 can be screwed off of or onto spool 24, as desired.

Spool 24 is substantially circular in cross-section and includes a T-shaped notch 70 which runs from first end 68 of spool 24 to a point near the second end 72 of spool 24. Notch 70 is structured to accommodate the first end 74 of paper sheet 56 which is also formed into a T-shape. Thus, paper sheet 56 can be removed from spool 24 simply by unscrewing threaded cap 66 from spool 24 and sliding paper sheet 56 out first end 68 of spool 24. Similarly, paper sheet 56 can be loaded onto spool 24 by fitting first end 74 into notch 70 and screwing threaded cap 66 onto spool 24.

Second mounting bracket 28 is secured, e.g., adhesively secured, to the interior of back surface 46, and extends outwardly into the interior of cover 22. Second mounting bracket 28 include a hole therethrough into which is placed a second end extension 76 of spool 24. This hole in second mounting bracket 28 is sized so that second end extension 76 is rotatable therein.

Connector 30 provides mechanical communication between second end extension 76 and the shaft 78 of motor 32. Second end extension 76 and shaft 78 are secured to connector 30 by a first set screw 80 and a second set screw 82.

Shaft 78 rotates in either direction as bi-directional motor 32 is activated. Motor 32 is secured, e.g., adhesively or otherwise secured, to the interior of back surface 46. Extending out from motor 32 are first rigid lead 34 and second rigid lead 32. First storage battery 38 and second storage battery 70 are secured in place, but can be moved, as described hereinafter, to contact first rigid lead 38 and second rigid lead 40, respectively. First storage battery 38 is contacted with first rigid lead 34 by manually pressing or pushing spring biased first push-button switch 42. Release of this manual pressure causes first storage battery 38 to come out of contact with first rigid lead 34. Similarly, second storage battery 40 is contacted with second rigid lead 36 by manually pressing or pushing spring biased second push button switch 44. Release of this manual pressure causes second storage battery 40 to come out of contact with second rigid lead 36.

First and second storage batteries 38 and 40 are oriented in opposing directions. Thus, when first storage battery 38 is brought into contact with first rigid lead 34, spool 24 turns in one direction, and when second storage battery 40 is brought into contact with second rigid lead 36, spool 24 turns in the opposite direction.

With paper sheet 56 descended from spool 24, the wall on which wall unit 20 is mounted can be used to aid in making notes on paper sheet 56 and/or flexible sheet 58.

Figure 3:
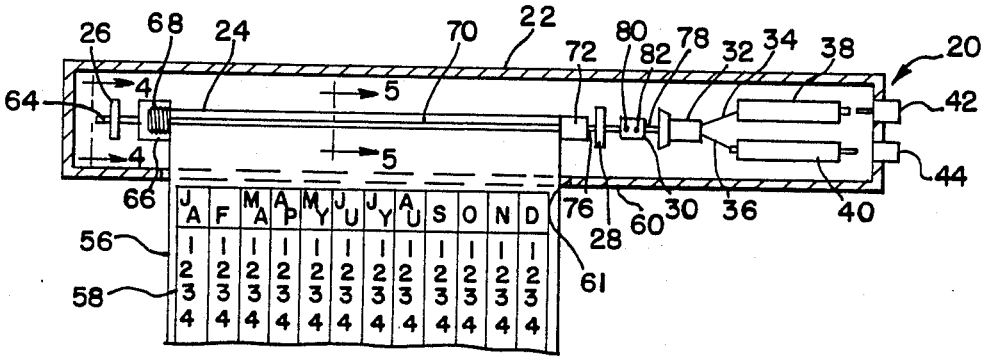
FIG. 3 is a front view, in cross-section, of the embodiment shown in FIG. 2.
Figure 4:
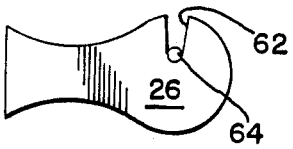
FIG. 4 is a detail view taken along line 4—4 of FIG. 3.
Figure 5:
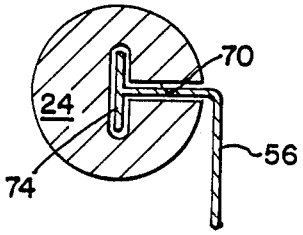
FIG. 5 is a detail view taken along line 5—5 of FIG. 3.

The rotation of spool 24, and ultimately the positioning of paper sheet 56 and flexible sheet 58, is controlled simply and effectively by selectively pushing first and second push button switches 42 and 44, respectively. Thus, paper sheet 56 and flexible sheet can be fully descended from spool 24, as shown in FIG. 3, or these components may be completely wound onto spool 28 and out of view in cover 22.

The present system allows calendar information to be easily available without such information continuously occupying valuable wall or desk space. Since notes or other information may be written on the paper sheet or flexible sheet, this system allows such notes or information to be hidden from sight simply by winding the paper sheet and the flexible sheet on the spool.

While this invention has been described with respect to various specific examples and embodiments, it is to be understood that the invention is not limited thereto and that it can be practiced within the scope of the following claims.

What is claimed is:

1. An apparatus for use as a calendar comprising:

flexible means on which is removably adhesively secured calendar indicia means including calendar information on a plurality of dates;

spool means associated with said flexible means and around which said flexible means is capable of being wound; and means associated with said spool means and capable of being activated to wind and unwind said flexible means around said spool means, said flexible means being structured so that when said flexible means is wound around said spool means said calendar indicia means is out of sight.

2. The apparatus of claim 1 wherein said means comprises a bi-directional electrically powered motor.

3. The apparatus of claim 2 wherein said motor is battery powered.

4. The apparatus of claim 3 wherein said activation of said motor is controlled by push-button switch means.

5. The apparatus of claim 1 wherein said flexible means is structured to be capable of being written upon.

6. The apparatus of claim 1 which further comprises cover means acting to substantially completely cover said spool means, provided that said cover means is structured to allow said flexible means to extend out of said cover means when said flexible means is unwound from said spool means.

7. The apparatus of claim 1 wherein said spool means is removably secured to said means.

8. The apparatus of claim 7 wherein said spool means includes a first end and a substantially opposing second end, said apparatus further comprises first mounting means and second mounting means acting to support said spool means at or near said first end and said second end, respectively, of said spool means.

9. The apparatus of claim 8 wherein at least one of said first and second mounting means includes a notch structured to receive said spool means at or near said first end or said second end.

10. The apparatus of claim 1 wherein said flexible means is removably secured to said spool means.

11. The apparatus of claim 10 wherein said spool means includes a slit-like structure and said flexible means includes a first end structured to be fit into said slit to attach said flexible means to said spool means.

12. The apparatus of claim 11 wherein said slit has a T-shaped cross-section.

13. The apparatus of claim 11 wherein said slit runs at least a substantial portion of the length of said spool means.

14. The apparatus of claim 1 wherein said calendar indicia means includes calendar information on at least one week.

15. The apparatus of claim 1 wherein said calendar indicia means includes calendar information on at least one month.

16. The apparatus of claim 1 wherein said calendar indicia means includes calendar information on at least one year.

17. The apparatus of claim 1 wherein said calendar indicia means is structured to be capable of being written upon.

18. The apparatus of claim 1 wherein said calendar indicia means is structured to be capable of being written upon.

19. An apparatus for use as a calendar comprising:

flexible means on which is located calendar indicia means including calendar information on a plurality of dates;

spool means structured and positioned so that said flexible means is removably secured thereto and around which said flexible means is capable of being wound, said spool means includes a slit-like structure with a T-shaped cross-section and said flexible means includes a first end structured to fit into said slit to removably secure said flexible means to said spool means; and means associated with said spool means and being capable of being activated to wind and unwind said flexible means around said spool means, said flexible means being structured so that when said flexible means is wound around said spool means said calendar indicia means is out of sight.

* * * * *